US005316533A

United States Patent [19]

Hoker

[11] Patent Number: 5,316,533

[45] Date of Patent: May 31, 1994

[54] BAND FOR DANCING AND EXERCISING

[76] Inventor: Jon J. Hoker, 8614 Vista View, Dallas, Tex. 75243

[21] Appl. No.: 982,610

[22] Filed: Nov. 27, 1992

[51] Int. Cl.[5] ..... A63B 21/02

[52] U.S. Cl. ..... 482/121; 482/148; 482/124

[58] Field of Search ..... 482/121-123, 482/51, 124-126, 129-130; 2/311, 312, 338, 300; 428/26-27; 273/DIG. 19; 434/253

[56] References Cited

U.S. PATENT DOCUMENTS

| | | | |
|---|---|---|---|
| 3,110,497 | 11/1963 | Broman et al. | 273/DIG. 19 |
| 3,458,188 | 7/1969 | InFante | 482/51 |
| 3,848,270 | 11/1974 | Rand | 2/311 |
| 4,327,909 | 5/1982 | Neufeld | 482/124 |
| 4,540,173 | 9/1985 | Hopkins, Jr. | 482/124 |
| 4,706,957 | 11/1987 | Jackson | 434/253 |
| 4,747,527 | 5/1988 | Trumpower, II | 2/311 |
| 4,765,748 | 8/1988 | Fidalgo | 273/DIG. 14 |

*Primary Examiner*—Stephen R. Crow
*Assistant Examiner*—Jerome Donnelly

[57] ABSTRACT

A new and improved apparatus for exercising and dancing includes a resilient, stretchable band element capable of encircling at least two rigid objects, such as two persons. When two person are encircled by the stretchable band element, the first person can exert an outwardly directed first force against a first portion of the interior side of the band element. Then the second person, who is also encircled by the band element, can experience an inwardly directed second force exerted by a second portion of the interior side of the band element. In addition, the second person can exert an outwardly directed third force against the second portion of the interior side of the band element. This third force is opposite in direction to the first force. The exercising and dancing apparatus can also include two belts, each one for individually encircling one of the two persons who are both encircled by the common band element. Snap connectors can be used to attach the individual belts to the common band element. Alternatively, one person can use the exercising device alone such as by having the band element encircle both himself/herself and a vertically standing object such as a pole, or such as by having the band element encircle both an upper and lower extremity of himself/herself. The exercising and dancing apparatus can also be used for dancing, with two or more people inside or outside the band.

6 Claims, 3 Drawing Sheets

BAND FOR DANCING AND EXERCISING

BACKGROUND OF THE INVENTION

1. Field of the Invention

The present invention relates generally to exercising devices and more particularly, to exercising devices that are especially adapted to be used by two or more persons.

2. Description of the Prior Art

Exercising devices are well known in the art and are designed for a wide variety of exercise modalities. More specifically, there are devices for exercising specific parts of the anatomy, and there are devices for exercising the entire body. For example, U.S. Pat. No. 4,603,856 of Flore discloses an exercising device designed for exercising an upper extremity. U.S. Pat. No. 4,751,896 of Miley and U.S. Pat. No. 4,765,279 of Klickstein each discloses a respective device designed to interconnect an adult and a child by a tether. U.S. Pat. No. 4,911,432 of Walden discloses a hip mounted exercising device which includes a rebound board placed against the pelvic area of a person, and a ball is tethered to the board by a stretchable tether. U.S. Pat. No. 4,915,396 of Chaisson discloses a hand held device that is used in exercising and dancing. The device has two handles, a different one of which is grasped by each dance or exercise partner. Thus, with this device, two persons can be exercising at the same time together.

Thus, while the foregoing body of prior art indicates it to be well known to use hand held exercising devices and to use hand held exercising devices for two persons to exercise together, the prior art does not disclose a simple and inexpensive, hands-free, exercise device with which two persons can exercise together. Nor does the prior art described above teach or suggest a hands-free exercising device that automatically exerts a second force on a second person when the first person exerts a force on the exercising device.

The foregoing disadvantages are overcome by the unique band for exercising and dancing of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved band for exercising and dancing which includes a resilient, stretchable band element capable of encircling at least two rigid objects, such as two persons, such that the first person is encircled by the band element and can exert an outwardly directed first force against a first portion of the interior side of the band element. Then the second person, who is also encircled by the band element, can experience an inwardly directed second force exerted by a second portion of the interior side of the band element. In addition, the second person can exert an outwardly directed third force against the second portion of the interior side of the band element. The band for exercising and dancing can also include two belts, each one for individually encircling one of the two persons who are both encircled by the common band element. The two belts can be opened and closed to encircle the individual persons individually. Snap connectors can be used to attach the individual belts to the common band element. The common band element can be comprised of a multilayer assembly which includes a resilient, stretchable core composed of silicone rubber, a resilient, stretchable core-jacketing layer composed of a synthetic rubber, and a resilient, stretchable outer layer, which jackets the core-jacketing layer and which is composed of a fabric. Alternatively, one person can use the exercising device alone such as by having the band element encircle both himself/herself and a vertically standing object such as a pole, or such as by having the band element encircle both an upper and lower extremity of himself/herself. As indicated in its title, the band for exercising and dancing can also be used for dancing with multi-number of dancers. The band can also be used for just fun play by kids.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved band for exercising and dancing which has all of the advantages of the prior art and none of the disadvantages.

It is another object of the present invention to provide a new and improved band for exercising and dancing which may be easily and efficiently manufactured and marketed.

It is a further object of the present invention to provide a new and improved band for exercising and dancing which is of durable and reliable construction.

An even further object of the present invention is to provide a new and improved band for exercising and dancing which is susceptible of a low cost of manufacture with regard to both materials and labor, and which accordingly is then susceptible of low prices of sale to the consuming public, thereby making such band for exercising and dancing available to the buying public.

Still yet a further object of the present invention is to provide a new and improved band for exercising and dancing which provides a simple and inexpensive, hands-free, exercise device with which two persons can exercise together.

Yet another object of the present invention is to provide a band for exercising and dancing that provides a hands-free exercising device that automatically exerts a second force on a second person when the first person exerts a force on the exercising device.

These together with still other objects of the invention, along with the various features of novelty which characterize the invention, are pointed out with particularity in the claims annexed to and form a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRA

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved band for exercising and dancing embodying the principles and concepts of the present invention will be described.

Figure 1:
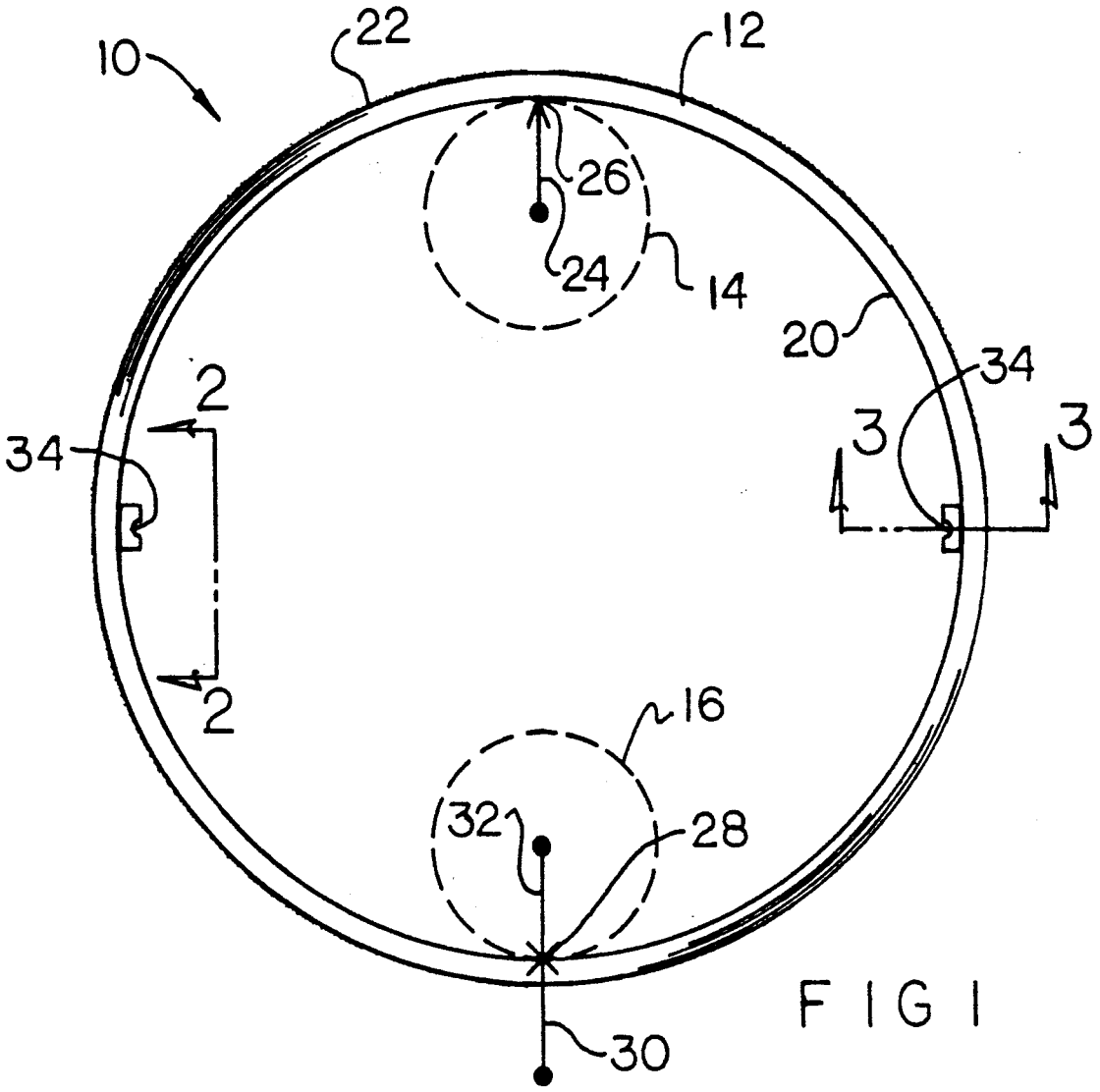
FIG. 1 is an elevational view showing a first preferred embodiment of the band for exercising and dancing of the invention.
Figure 2:
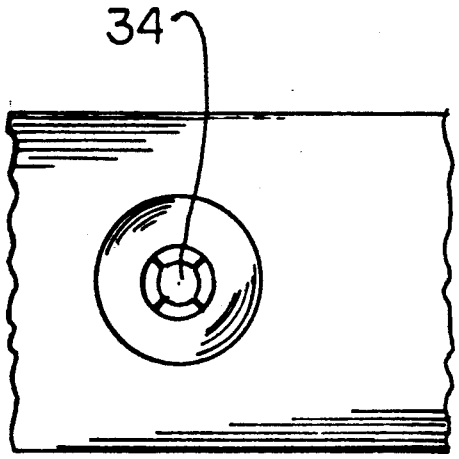
FIG. 2 is an enlarged view of a portion the interior side of the band for exercising and dancing of the invention shown in FIG. 1 taken along the line 2—2.
Figure 3:
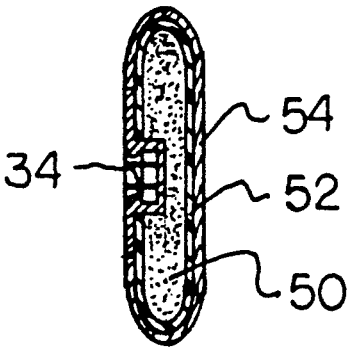
FIG. 3 is a cross-sectional view of the band for exercising and dancing of the invention shown in FIG. 1 taken along line 3—3 thereof.
Figure 7:
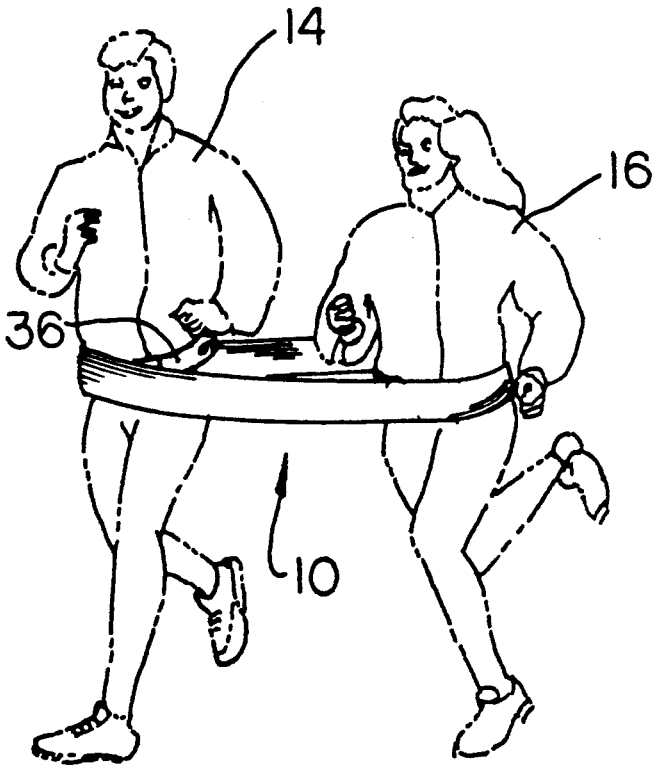
FIG. 7 is a perspective view of the embodiment of the invention shown in FIG. 4 in use on two persons.
Figure 8:
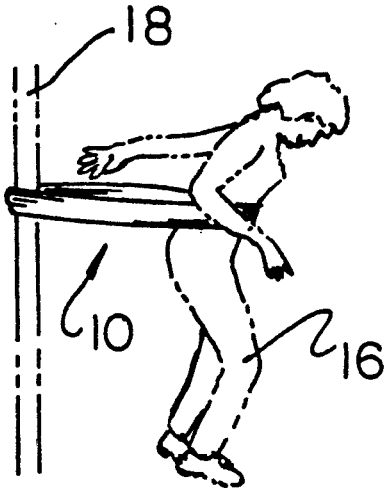
FIG. 8 is a perspective view of the embodiment of the invention shown in FIG. 1 used by one person who is using a vertical pole.

Turning initially to FIGS. 1-3, there is shown a first exemplary embodiment of the band for exercising and dancing of the invention generally designated by reference numeral 10. In its preferred form, band for exercising and dancing 10 is comprised of a resilient, stretchable band element 12 which is capable of encircling at least two rigid objects. In FIG. 7, the two rigid objects are a made person 14 and a female person 16. In FIG. 8, the two rigid objects are female person 16 and vertical pole 18. Although not shown in the drawings, the two rigid objects can be a person's upper and lower extremities.

As shown in FIG. 1, the band element 12 has an interior side 20 and an exterior side 22. When a first person 14 (both persons 14 and 16 being shown as phantom schematic cross-sections in FIG. 1) exerts an outwardly directed first force (represented by vector 24) against a first portion 26 of the interior side 20 of the band element 12, then a second portion 28 of the interior side 20 of the band element 12 exerts an inwardly directed second force (represented by vector 30) against the second person 16. Moreover, if person 16 so desires, then that person can exert an outwardly directed third force (represented by vector 32) against the second portion 28 of the interior side 20 of the band element 12.

Optionally, as shown in FIGS. 2 and 3, the band for exercising and dancing 10 of the invention can include a female connector member 34 attached to the band element 12.

Figure 4:
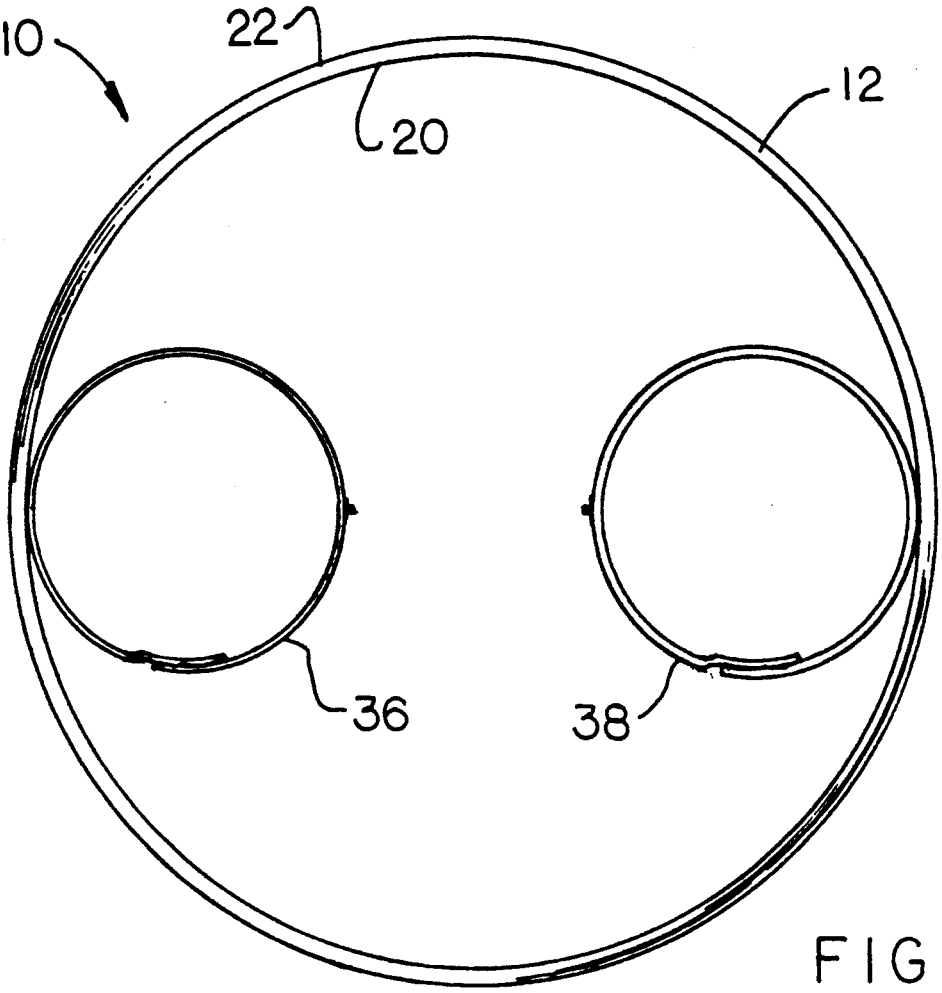
FIG. 4 is an elevational view of a second preferred embodiment of the invention in which individual belts are provided for individual persons.
Figure 5:
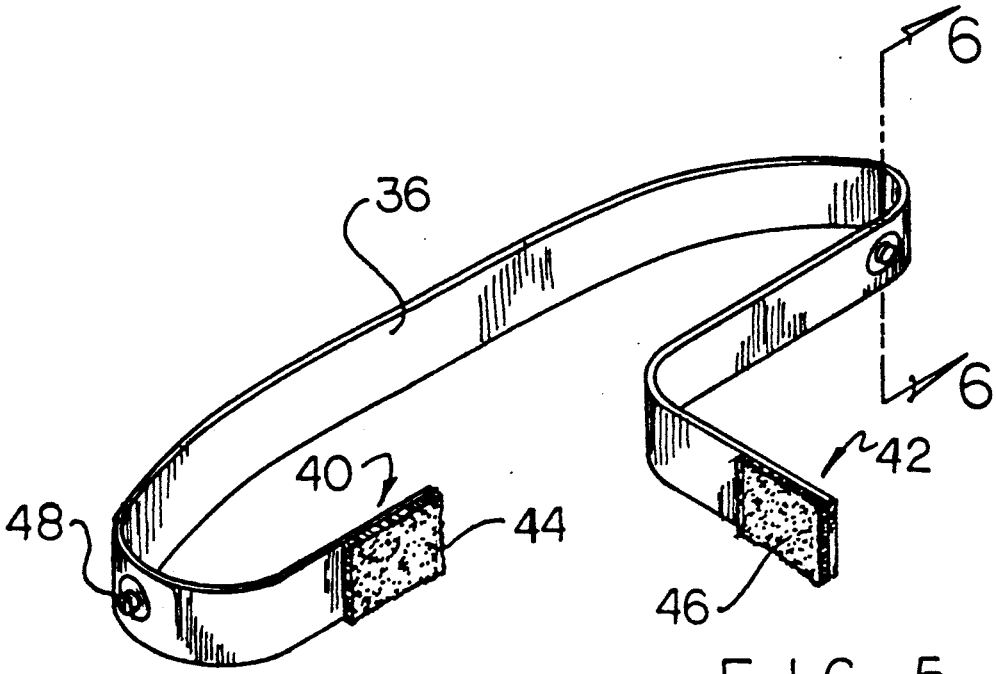
FIG. 5 is an enlarged view of one of the additional belts shown in FIG. 4.
Figure 6:
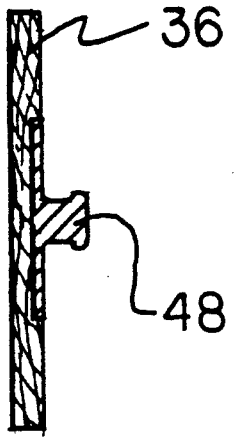
FIG. 6 is an enlarged cross-sectional view of the belt shown in FIG. 5 taken along the line 6—6.

Turning to FIGS. 4, 5, and 6, a second embodiment of the band for exercising and dancing 10 of the invention is shown. In FIGS. 4, 5, and 6, reference numerals are shown that correspond to like reference numerals that designate like elements shown in the other figures. In addition, two belts 36 and 38 are shown in FIG. 4. Each belt 36 and 38 is for encircling one person 14 or 16 (not shown in this figure).

Taking belt 36 as an example, each belt includes a first end 40 and a second end 42. A first connector (pile connector 44) is located on the first end 40; and a second connector (loop connector 46) is located on the second end 42. Pile connector 44 and loop connector 46 form a complementary loop/pile connection when they are connected together after a person has been encircled by the belt 36. The loop/pile connection can be made with the well-known VELCRO(TM) material.

A third connector (male snap element 48) is present on the belt 36 and is used for connecting the belt 36 to the band element 12 using a fourth connector such as the female connector 34 on the band element 12. In FIG. 6, male snap element 48 is shown on belt 36. The connection between the band element 12 and the belt 36 prevents the band for exercising and dancing 10 from falling down when tension is not exerted on the band element 12 by the persons encircled by the band element 12.

Turning back to FIG. 3, the band element 12 is comprised of a multilayer assembly which includes a resilient, stretchable core 50 composed of a silicone rubber, a resilient, stretchable core-jacketing layer 52, composed of a synthetic rubber, that jackets the core 50, and a resilient, stretchable outer layer 54 composed of a fabric, such as SPANDEX(TM), that jackets the core-jacketing layer 52. Alternatively, the band element 12 could be fabricated from the same material that is employed in bungee cords. The band for exercising and dancing 10 can employ a band element 12 that is 6 to 8 inches wide, and that has three alternative lengths: small to accommodate 1-2 people; medium to accommodate 3-4 people; and large to accommodate 4 or more people.

In FIG. 7, the persons 14 and 16 are shown doing a running exercise. When the band for exercising and dancing 10 of the invention is used in running by two persons, the lead person can especially develop upper thigh muscles, and the trailing person can especially develop calf muscles as resistance through stretching the band element 12 occurs. Furthermore, the slight pulling action of the lead person on the trailing person can provide a gentle pressure on the trailing person's back, thereby increasing motivation and reducing fatigue. The lead runner can also do an about-face and run backwards, thereby placing stress and exercise on other leg muscles.

The band for exercising and dancing 10 of the invention can also be used for arm curls, leg curls, etc. In essence, the band for exercising and dancing 10 of the invention can be used as a one-person or two-person trainer.

With respect to FIG. 7, the persons 14 and 16 could readily use the band for exercising and dancing 10 of the invention for dancing. Moreover, three or more persons can be encircled by the band element 12 to either exercise or dance.

With respect to dancing without the belt the band for exercising and dancing 10 of the invention provides a new dance form or method of dancing. More specifically, the new method of dancing comprises the steps of: encircling at least two persons 14 and 16 with a resilient, stretchable band element 12; directing an outwardly directed first force 24 against the resilient, stretchable band element 12 by a first person 14 (of at least two persons); permitting a second person 16 to direct an outwardly directed additional force 32 against the resilient, stretchable band 12, wherein the outwardly directed first force 24 and the outwardly directed additional force 32 are in opposing directions (see FIG. 1).

In FIG. 8, the person 16 is exercising with the band for exercising and dancing 10 of the invention along with a vertical post 18. Both the person 16 and the post 18 are encircled by the band for exercising and dancing 10.

Although only one side of the band for exercising and dancing 10 of the invention is shown in the drawings described above, it is understood the invention can be produced in different sizes to accommodate different numbers of people or different size people such as children or adults.

Moreover, the band for exercising and dancing 10 of the invention has a wide variety of additional benefits. It can be used as an "ice breaker" for parties. It can be manufactured inexpensively is a variety of stylish colors. It can be color coordinated with accompanying carry bags. It can be used by children for play and for indirectly and simultaneously providing beneficial exercise. It can be used by persons needing rehabilitation, e.g. to assist in walking during convalescence or by elderly patients needing exercise, but not having the strength to ambulate without assistance. Utilizing both the front and rear inner belt of the band, the lead person could apply just enough pressure when walking at the desired pace against the back of the patient thereby keeping the patient upright, and taking stress off the patient's back and/or legs. If the lead person or helper is facing the patient and walking backwards, face-to-face verbal encouragement may be offered and the helper is in a position to reach the patient for additional support, or merely to hold the hands of the patient thereby lending additional encouragement and motivation.

It is apparent from the above that the present invention accomplishes all of the objects set forth by providing a new and improved band for exercising and dancing that is low in cost, relatively simple in design and operation, and which may advantageously be used for both exercising and dancing.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. An excercising device, comprising:

a resilient, stretchable band element capable of encircling at least two rigid objects and including an interior side and an exterior side, said band element having a continuous circumferential extent large enough to accommodate one or more rigid objects within the circular opening defined by said continuous circumferential extent, first and second belt means for encircling each said two rigid objects, respectively, wherein said rigid objects are vertically oriented, each of said first and second belt means including, a first end and a second end;

a first connecting means, located at said first end of said belt means, for connecting with a second end connecting means; and a second connecting means, located at said second end of said belt means, for connecting with said first end connecting means, and third connecting means for connecting said belt means to said resilient, stretchable band element; and further comprising fourth connecting means, located on the inside circumferential surface of said resilient, stretchable band element, for connecting said resilient, stretchable band element to said third connecting means of said first belt, means and fifth connecting means, located on the inside circumferential surface of said resilient, stretchable band element, and being circumferentially spaced from said fourth connecting means for connecting said resilient, stretchable band element to said third connecting means of said second belt, means such that at least one of the two rigid objects can exert an outwardly directed first force against a first portion of said interior side of said resilient, stretchable band element, and such that a second portion of said interior side of said resilient, stretchable band element exerts an inwardly directed second force against another of the at least two rigid objects, at least one of said rigid objects is a human.

2. The apparatus described in claim 1 wherein at least two rigid objects include two human beings.

3. The apparatus described in claim 1 wherein one of said at least two rigid objects includes a human being, and one of said at least two rigid objects includes a vertically standing pole.

4. The apparatus described in claim 1 wherein said means for connecting said belt means to said resilient, stretchable band element includes a male portion of a snap connector.

5. The apparatus described in claim 1 wherein said resilient, stretchable band element is comprised of a multilayer assembly which includes:

a resilient, stretchable core;

a resilient, stretchable core-jacketing layer, that jackets said core; and a resilient, stretchable outer layer, that jackets said core-jacketing layer.

6. The apparatus described in claim 5 wherein:

said core is comprised of a silicone rubber;

said core-jacketing layer is comprised of a synthetic rubber; and said outer layer is comprised of a resilient, stretchable fabric.

* * * * *